US005179967A

United States Patent [19]

Mattiussi

[11] Patent Number: 5,179,967

[45] Date of Patent: Jan. 19, 1993

[54] APPARATUS FOR RINSING METAL STRIP

[75] Inventor: Albert S. Mattiussi, Burlington, Canada

[73] Assignee: Nelson Steel, Stoney Creek, Canada

[21] Appl. No.: 751,394

[22] Filed: Aug. 28, 1991

[51] Int. Cl.[5] ..... B08B 3/08

[52] U.S. Cl. ..... 134/60; 134/64 R

[58] Field of Search ..... 134/60, 64 R, 122 R; 266/112

[56] References Cited

U.S. PATENT DOCUMENTS

| | | | |
|---|---|---|---|
| 3,096,214 | 7/1963 | Wells, Jr. et al. | 134/122 R X |
| 4,039,349 | 8/1977 | Kwasnoski et al. | 134/64 R X |
| 4,850,378 | 7/1989 | Mattiussi | 134/64 R X |
| 4,986,291 | 1/1991 | Hula et al. | 134/122 R |
| 5,060,683 | 10/1991 | Seiz et al. | 134/64 R |

FOREIGN PATENT DOCUMENTS

| | | | |
|---|---|---|---|
| 2-133589 | 5/1990 | Japan | 134/122 R |
| 1333943 | 10/1973 | United Kingdom | 266/112 |

*Primary Examiner*—Philip R. Coe
*Attorney, Agent, or Firm*—Bereskin & Parr

[57] ABSTRACT

An apparatus for rinsing metal strip has a rinse tank with an inlet end, an outlet end, a bottom and sides. The bottom has an upper surface which slopes upwardly toward the inlet and the outlet ends to define a respective weir at each of the inlet and outlet ends. The bottom further has rinse fluid ports for discharging rinse fluid onto the upper surface. The apparatus has a rinse fluid supply means for supplying rinse fluid to the rinse fluid ports. The apparatus further has control means for controlling the depth of rinse fluid flowing over the weirs to completely immerse metal strip in rinse fluid as the metal strip is passed through the rinse tank and across the weirs. A method of rinsing metal strip uses a rinse tank as generally described above and comprises the steps of:

1) supplying rinse fluid to the rinse tank;
2) passing metal strip across the weirs from the inlet to the outlet;
3) allowing the rinse fluid to overflow the weirs and the edges of the metal strip to flood the upper surface of the metal strip; and,
4) controlling the depth of the rinse fluid to completely submerse the metal strip in the rinse fluid between the weirs.

12 Claims, 2 Drawing Sheets

APPARATUS FOR RINSING METAL STRIP

FIELD OF THE INVENTION

This invention relates to surface treatment of metal strip and more particularly relates to rinsing of steel strip as it emerges from a pickling process.

BACKGROUND OF THE INVENTION

In the manufacture of metal strip such as steel plate and steel sheet, a heated slab of steel is passed between rollers in a rolling mill. This reduces the thickness of the slab to transform it into steel strip. Such treatment is referred to as "hot rolling" as the slab is introduced into the rolling mill in a red hot state. The finished product from the rolling mill is accordingly called "hot rolled steel" and is generally coiled for transport and further processing.

The subsequent processing of hot rolled steel may include: cold rolling to further reduce thickness; painting; galvanizing; and plating with chrome or other metals.

In view of the tendency of steel to oxidize, in particular at the high temperatures used during hot rolling, it is generally necessary to surface treat the hot rolled strip to render it suitable for subsequent processing. One method of surface treating the hot rolled steel strip is referred to as "pickling" and involves passing the strip through an acid bath to dissolve any surface oxides or impurities.

Immediately subsequent to pickling, it is necessary to rinse the steel strip to remove any remaining acid. Failure to rinse the acid from the strip will result in corrosion damage to the strip.

Thinner strip (up to 0.250" thick) may be pickled in continuous pickle lines which have a series of deflector rolls, which bend the sheet in motion in order to pass it through a rinse bath. For thicker strip, a push-pull pickle line is utilized which does not have the bending feature. In a push-pull pickle line, the strip is fed through generally horizontally and pickling and rinsing fluids are sprayed at the sheet.

Oxidation of the pickled strip is often encountered in the rinsing stages utilizing a spray type rinse system on all types of pickle lines, during line stops. Such line stops may take place according to schedule or may be inadvertent. Those portions of the strip which are exposed to air will generally commence oxidizing in approximately 30 seconds, resulting in staining of the sheet which gives rise to poor adhesion of paint or plating materials, and cosmetic surface blemishes. Furthermore, although the use of a spray system avoids having to bend heavier gauge metal strip, the spraying of rinse fluid results in air entrainment in the rinse fluid.

An object of the present invention is to provide a rinse system for all types of pickling lines, that will tolerate longer line shutdowns than that taking place in conventional spray systems, without oxidation of the strip surface.

It is a further object of this invention to provide a rinse system for all strip thicknesses, which avoids direct spraying of rinse fluid at the metal strip.

It is a still further object of the present invention to provide a rinse system which is efficient in the use of rinse fluids in order to minimize the fresh fluid requirement.

SUMMARY OF THE INVENTION

An apparatus for rinsing metal strip, said apparatus comprising:

a rinse tank having an inlet end, an outlet end, a bottom and sides, said bottom having an upper surface which slopes upwardly toward each of said inlet end and outlet end to define a respective weir at each of said inlet and outlet ends, said bottom further having rinse fluid ports for discharging and distributing rinse fluid onto said upper surface;

rinse fluid supply means for supplying rinse fluid to said rinse fluid ports; and control means for controlling the depth of rinse fluid flowing over said weirs to completely immerse said metal strip in said rinse fluid as said metal strip is passed through said rinse tank and across said weirs.

The apparatus may further comprise means for admixing rinsing additives in the rinse fluid in the rinse fluid supply means.

A method of rinsing metal strip using a rinse tank having an inlet, an outlet, a respective weir at each of said inlet and said outlet, rinse fluid supply means for supplying rinse fluid to said rinse tank and control means for controlling the depth of rinse fluid flowing over said weirs, said method comprising the steps of:

1) supplying rinse fluid to said rinse tank;

2) passing said metal strip across said weirs from said inlet to said outlet;

3) allowing said rinse fluid to overflow said weirs and to overflow the edges of said metal strip to flood an upper surface of said metal strip; and, 4) controlling the depth of said rinse fluid to completely submerge said metal strip in said rinse fluid between said weirs.

The method of rinsing metal strip may optionally be preceded by a step for admixing rinsing additives in the rinse fluid.

DESCRIPTION OF THE DRAWINGS

A preferred embodiment of the invention is described below with reference to the attached drawings in which.

DESCRIPTION OF PREFERRED EMBODIMENT

Figure 1:
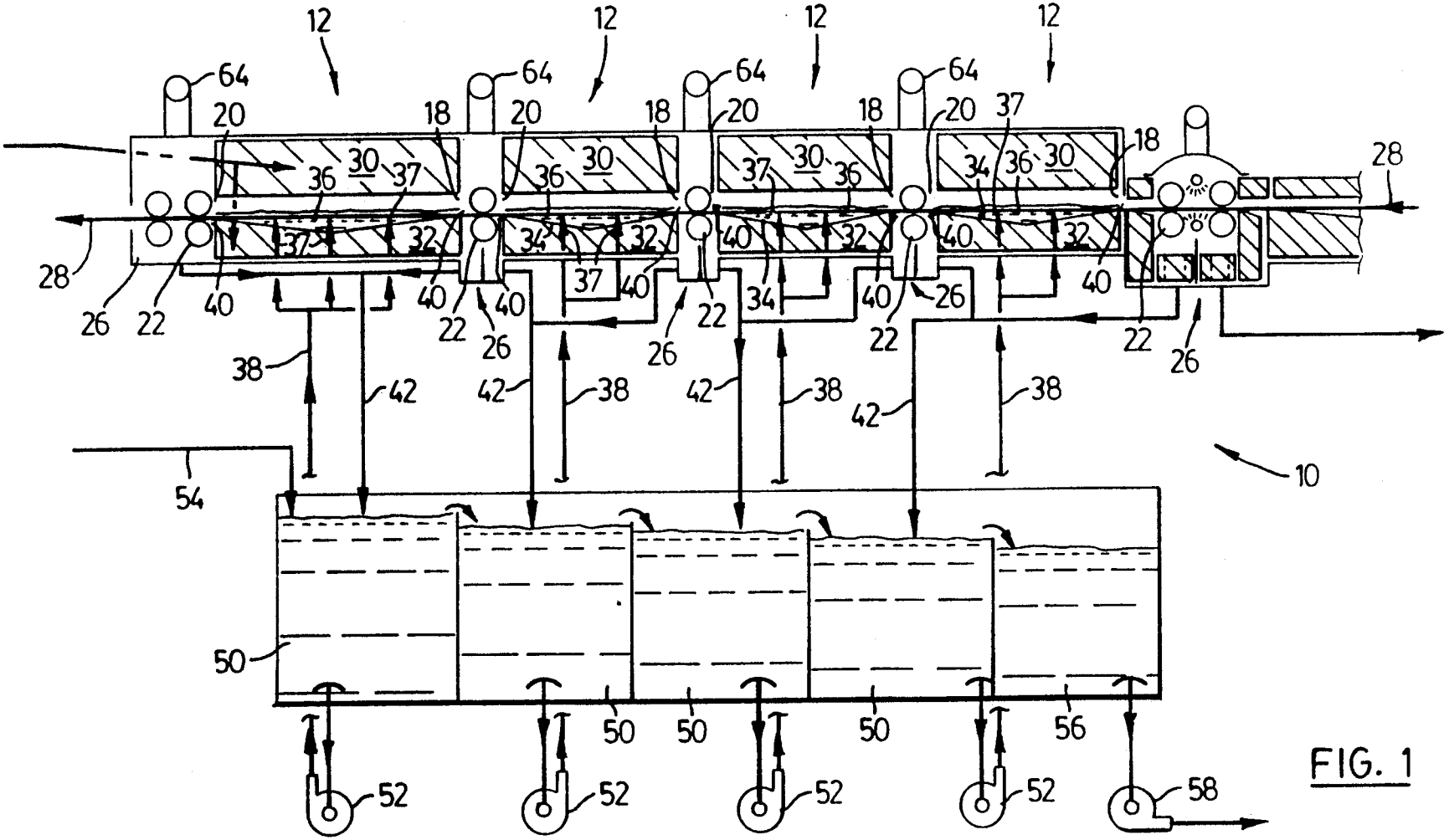
FIG. 1 is a schematic representation of an apparatus according to the present invention.

An apparatus according to the present invention is generally shown at 10. The apparatus has a series of four rinse tanks 12. Each of the rinse tanks 12 has an inlet end 18 toward the right and an outlet end 20 toward the left.

Vertically opposed feed rollers 22 are located at the inlets 18 and the outlets 20. Troughs 26 are provided below the feed rollers 22. The purpose of the troughs 26 is discussed in more detail below.

Metal strip 28 is fed into the inlet 18 of the right rinse tank 12 as viewed in FIG. 1, through the intermediate rinse tanks 12, and out of the outlet 20 of the left rinse tank 12. This direction corresponds to the "downline" direction of the metal strip 28. The opposite is referred to as the "upline" direction.

Figure 2:
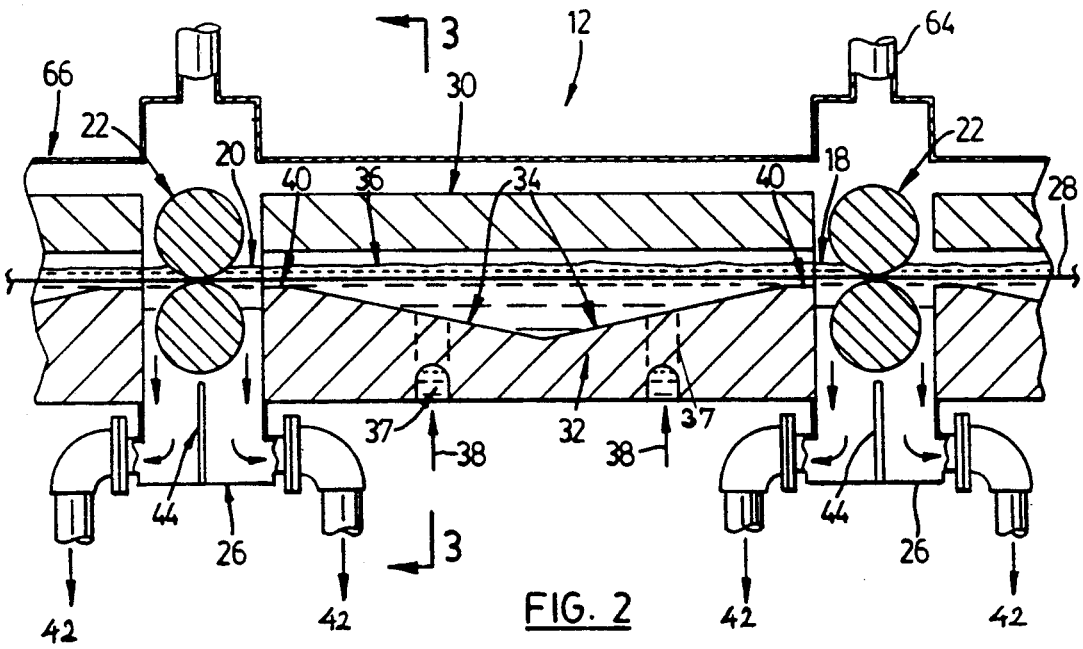
FIG. 2 and 3 are sectional views of a rinse tank of the apparatus schematically represented on FIG. 1.
Figure 3:
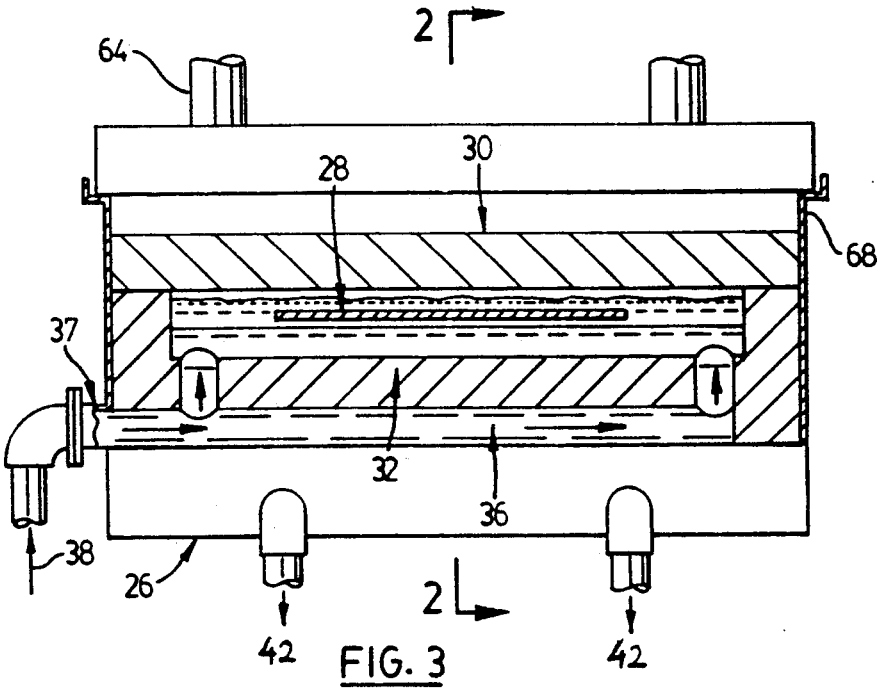

One of the four rinse tanks 12, is shown in greater detail on FIG. 2. Each of the rinse tanks 12 has a respective granite cover 30 and a respective granite bottom liner 32. The rinse tanks 12 also have generally flat granite sides, which may be seen on FIG. 3 representing the cross-sectional view of rinse tank 12. Wall elements 68, shown on FIG. 3, enclose the tank. The granite bottom liners 32 have respective contoured upper surfaces 34 which face the underside of the metal strip 28. The distance between the metal strip 28 and the upper surfaces 34 is greatest between the respective inlet 18 and respective outlet 20 of each of the tanks 12. The distance between the upper surface 34 and the metal strip 28 diminishes toward the respective inlets 18 and outlets 20. Accordingly, the upper surfaces define a well or recess below the metal strip 28 which is deepest toward the respective centers of the rinse tanks 12 and which becomes shallower toward the respective inlets 18 and outlets 20 of those rinse tanks.

Rinse fluid 36 is introduced into the bottom of the respective rinse tanks 12 through suitable rinse fluid ports 37. The direction of rinse fluid introduction is schematically illustrated by arrows 38. To minimize turbulence in the rinse fluid 36, suitable baffles or diffusers may be used at the entry points of rinse fluid 36 into the tanks 12.

The highest parts of the upper surfaces 34 of the bottom liners 32 define weirs 40 adjacent the inlets 18 and outlets 20 of the rinse tanks 12. In use, rinse fluid 36 is fed into the rinse tanks 12 through the rinse fluid ports 37, builds up on the upper surfaces 34 of the bottom liners 32 and overflows the weirs 40 into the troughs 26. According to the present invention, rinse fluid 36 is pumped into the rinse tanks 12 at a rate great enough to cause the equilibrium depth of rinse fluid 36 overflowing the weirs 40 to cover both surfaces of the metal strip 28.

The rate at which the rinse fluid 36 can flow out of the tank is controlled by several factors. Firstly, the feed rollers 22 press against opposite faces of the metal strip 28 and generally prevent flow of rinse fluid 36 between the faces of the metal strip 28 and the feed rollers 22. Secondly, the horizontal spacing between the rollers 22 and the weirs 40 will affect the rate at which rinse fluid 36 can flow between the feed rollers 22 and the weirs 40 into the troughs 26. Thirdly, the spacing between the ends of the feed rollers 22 and the sides of the tanks 12 will also have an effect on the rate at which the rinse fluid 36 can flow past the ends of the rollers 22. Accordingly, the selection of the above spacings in combination with the rate at which the rinse fluid 36 is supplied to the rinse fluid ports 37 may be used as a control means to control the depth of rinse fluid 36 in the tanks 12. Typically the depth of rinse fluid 36 would be about 1" to 2" above the weir 40 and the underside of the metal strip 28 would pass about ¼ above the weirs 40.

The breadth which would be selected for the rinse tanks 12 would depend on the intended breadth of the metal strip 28 which the rinse tanks 12 are to accommodate. The tanks 12 would generally be made to provide at least one foot of clearance on either side between the metal strip 28 and the sides of the tanks 12. This enables rinse fluid 36 to flow from the underside of the metal strip 28 and around the edges of the metal strip 28 to overflow the upper surface of the metal strip 28.

A feature to consider in selecting the slope of the contoured surfaces 34 of the bottom liners 32 of the rinse tanks 12 is the introduction of metal strip 28 into the rinse tanks. Although relatively thick metal strip can be passed across the rinse tanks 12 without significant downward bending of the metal strip 28, thinner metal strip 28 will tend to sag into the wells defined by the upper surfaces 34. If the upper surfaces 34 are too steeply inclined or have any upward protrusions, the end of the metal strip 28 may get caught resulting in buckling as the remainder of the strip is fed into the rinse tanks 12. Accordingly, a suitably gradual slope should be selected, particularly toward the outlet end 20 of the tanks 12.

The troughs 26 have partitions 44 extending along their bottoms and between their ends to divide the troughs 26 into two halves. This effectively provides a separate trough adjacent each inlet 18 and outlet 20. Each half of the troughs 26 receives rinse fluid from the respective rinse tank 12 immediately adjacent to it. The partitions 44 avoid or minimize mixing of rinse fluid 36 emanating from the two adjacent rinse tanks 12.

Each of the rinse tanks 12 is fluidly connected to a respective rinse recirculation tank 50. Each of the rinse recirculation tanks 50 has a respective pump 52 which pumps rinse fluid 36 into the respective rinse tanks 12. Each half of the troughs 26 has a respective drain to drain rinse fluid back into the respective rinse recirculation tank from whence it came. Arrows 42 schematically illustrate the return (exit) path of rinse fluid 36 into the rinse recirculation tanks 50.

The rinse recirculation tanks 50 illustrated in FIG. 1 are cascaded so that overflow from each of the recirculation tanks 50 flows into the rinse recirculation tank 50 immediately to its right. Fresh rinse fluid is introduced into the left-hand rinse recirculation tank 50 as shown schematically through a fill line 54. Overflow from the right-hand recirculation tank 50 flows into an overflow tank 56 from which it is pumped by pump 58 to a rinse fluid treatment system.

The purpose for cascading the rinse recirculation tanks and connecting each rinse tank 12 to a separate rinse recirculation tank is to provide multistage rinsing. It will be appreciated that metal strip 28 coming out of a pickling process will have pickling fluid adhering to its surfaces having generally the same concentration as the pickling fluid in the pickling tank. A considerable amount of fresh water would be required to adequately rinse the pickling fluid from the surfaces of the metal strip 28 if the metal strip 28 were to pass only through a single rinse tank. A reason for this is that the pickling fluid will dissolve into the rinse fluid and contaminate the rinse fluid.

In the system illustrated in FIG. 1, the metal strip 28 is rinsed in four separate rinse operations commencing at the right-hand rinse tank 12 and terminating at the left-hand rinse tank 12. In view of the high concentration of pickling fluid adhering to the metal strip as it enters the right-hand rinse tank 12, a significant portion of that pickling fluid may be removed using rinse fluid 36 that is not entirely pure. In contrast, relatively pure rinse fluid 36 would be required to dissolve pickling fluid which has been diluted by passage through previous rinse tanks. Accordingly, fresh rinse fluid is introduced into the left-hand rinse tank 12 and used as a final rinse in that rinse tank. Any pickling fluid picked up by the rinse fluid 36 in the left-hand rinse tank 12 would not be very significant and accordingly, that fluid may overflow into the adjacent rinse recirculation tank 50 to be used in the rinse tank 12 which is second from the left in FIG. 1. Similarly, rinse fluid from each of the rinse tanks 12 may be used in the rinse tank 12 to its right.

The fresh rinse fluid requirement would depend on the square footage of steel passing through the rinse tanks 12. Flow from the fill line 54 may be controlled by a metering pump or suitable valving to correspond to the square footage of steel being processed.

One advantage of the rinse system described above is that it generally provides a coating of rinse fluid 36 on the metal strip 28 while the metal strip 28 is in the rinse tanks 12. This coating of rinse fluid 36 prevents air from contacting the surfaces of the metal strip 28 to significantly reduce the possibility of staining, particularly when the metal strip 28 is stationary. Another advantage of the rinse system described above is that the metal strip is in effect passed through a bath of rinse fluid 36 rather than having rinse fluid 36 sprayed at its surfaces. This avoids staining of the metal strip 28 which may otherwise be caused by air entrainment in the rinse fluid 36 which might occur if the rinse fluid 36 were sprayed.

A still further advantage of the present invention is that it effectively immerses steel, ferrous alloy, or metal strip of any kind, having thickness varying from the thin to the relatively thick, in a rinse fluid bath without bending the metal strip around deflector rollers.

As there are typically some fumes generated by the pickling acid present in the rinse tanks 12, a fume system schematically indicated by reference 64 may be provided to draw those fumes off. The fume hood 66, may be incorporated in the fume system 64.

It has been found that a rinsing additive such as citric acid, or similar chemical agents equivalent to citric acid, when added to the rinsing fluid may further improve the surface appearance of the steel strip. Citric acid was found to be effective in concentrations less than 0.20%. The presence of citric acid or its chemical equivalent, is an optional requirement only of the present invention.

The above description is intended in an illustrative rather than a restrictive sense. Variations to the specific embodiment described may be apparent to those skilled in the relevant arts without departing from the spirit and scope of the present invention as set forth in the claims below.

I claim:

1. An apparatus for rinsing metal strip, said apparatus comprising:

at least two adjacent rinse tanks, each rinse tank having an inlet end, an outlet end, a bottom and sides, said bottom having an upper surface which slopes upwardly toward each of said inlet end and outlet end, to define a respective weir at each of said inlet and outlet ends, said bottom further having rinse fluid ports for discharging rinse fluid onto said upper surface;

rinse fluid supply means for supplying rinse fluid to said rinse fluid ports; and control means located between said two adjacent tanks for controlling and maintaining the level of said rinse fluid above said strip within each tank and between said adjacent tanks, so that said strip is submerged in each tank and between said adjacent tanks.

2. An apparatus as claimed in claim 1, wherein said control means comprises:

a pair of feed rollers adjacent said inlet and outlet ends between said adjacent tanks for feeding said metal strip through said tanks across said weirs and between said tanks, said pair of feed rollers being spaced apart from said sides of said tanks by a predetermined amount, said predetermined amount acting in conjunction with the rate of supply of said supply means, to maintain said level of fluid.

3. An apparatus as claimed in claim 2, further having:

a trough beneath said pair of feed rollers for receiving rinse fluid;

a rinse fluid recirculation tank for receiving and supplying said rinse fluid;

a drain fluidly connecting said rinse recirculation tank and each said trough for transferring rinse fluid from each said trough to said rinse recirculation tank; and wherein said fluid supply means includes a pump fluidly connected to said rinse recirculation tank and said rinse fluid ports for pumping fluid from said rinse recirculation tank to said fluid ports.

4. An apparatus as claimed in claim 3 wherein said control means is capable of maintaining a depth of rinse fluid of at least 1" above said weirs.

5. An apparatus as claimed in claim 3 wherein said bottom and said sides have granite liners.

6. An apparatus as claimed in claim 5 further having a granite lined top cover above said upper surface.

7. An apparatus as claimed in claim 5 wherein the slope of said upper surface is selected to act as a guide for guiding an end of a metal strip passing therealong toward said outlet end without buckling of said metal strip.

8. An apparatus as claimed in claim 7, wherein said rinse fluid ports include means for minimizing the amount of air entrainment in discharging rinse fluid onto said upper surface.

9. An apparatus comprising a series of rinse tanks as claimed in claim 3, and wherein:

said series of rinse tanks includes a first rinse tank, a last rinse tank and at least one intermediate rinse tank between said first and last rinse tanks;

said metal strip passes through said rinse tanks in a downline direction from said first rinse tank through each said intermediate rinse tank and out of said last rinse tank;

said rinse fluid recirculation tanks of said series of rinse tanks are fluidly connected to cause overflow from each said rinse fluid recirculation tank to flow into the respective rinse fluid recirculation tank corresponding to the rinse tank immediately upline thereof;

said rinse fluid recirculation tank corresponding to said last rinse tank is fluidly connected to a fresh rinse fluid supply from which fresh rinse fluid is fed into said rinse tank;

said rinse fluid recirculation tank corresponding to said first rinse tank overflows into an overflow tank.

10. An apparatus as claimed in claim 9 additionally comprising, means for admixing a rinsing additive with said rinse fluid in said rinse fluid supply means.

11. An apparatus as claimed in claim 3, said trough further comprising a partition for dividing said trough, so separate rinse fluid flowing from one of said rinse tanks from rinse fluid flowing from said adjacent rinse tank.

12. An apparatus as claimed in claim 1, additionally comprising, means for admixing a rinsing additive with said rinse fluid in said rinse fluid supply means.

* * * * *